US008093796B2

(12) United States Patent
Hashizume

(10) Patent No.: US 8,093,796 B2
(45) Date of Patent: Jan. 10, 2012

(54) ELECTRON BEAM APPARATUS AND IMAGE DISPLAY APPARATUS

(75) Inventor: Yohei Hashizume, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/761,055

(22) Filed: Apr. 15, 2010

(65) Prior Publication Data

US 2010/0283379 A1 Nov. 11, 2010

(30) Foreign Application Priority Data

May 11, 2009 (JP) ..... 2009-114592

(51) Int. Cl.
*H01J 1/62* (2006.01)
*H01J 1/02* (2006.01)

(52) U.S. Cl. ..... 313/495; 313/496; 313/311; 313/497

(58) Field of Classification Search ..... 313/495–497, 313/306, 309–311, 351, 346 R, 336, 292, 313/238; 445/24
See application file for complete search history.

(56) References Cited

U.S. PATENT DOCUMENTS 6,635,984 B1 10/2003 Shibata
2004/0113540 A1* 6/2004 Niibori et al. ..... 313/495
2005/0248257 A1* 11/2005 Yoo ..... 313/496
2007/0216286 A1 9/2007 Tanabe
2009/0001870 A1 1/2009 Suzuki et al.

FOREIGN PATENT DOCUMENTS

EP 0 354 750 A2 2/1990
JP 02-046636 A 2/1990

OTHER PUBLICATIONS

European Search Report dated Feb. 10, 2011.

* cited by examiner

*Primary Examiner* — Karabi Guharay
*Assistant Examiner* — Elmito Breval
(74) *Attorney, Agent, or Firm* — Fitzpatrick, Cella, Harper & Scinto

(57) ABSTRACT

An electron beam apparatus 11 comprises a substrate 1, a first electrode wiring 2 formed on the substrate 1, an insulating layer 4 covering the first electrode wiring 2, a second electrode wiring 3 formed on the insulating layer 4 so as to cross the first electrode wiring 2, and on the substrate 1, an electron emitting device 6 located distant from an electrode wiring crossing region 9 where the first electrode wiring 2 and the second electrode wiring 3 cross each other, and connected to both the first electrode wiring 2 and the second electrode wiring 3 so as to receive drive energy from the first electrode wiring 2 and the second electrode wiring 3, wherein a void 5 is formed between the first electrode wiring 2 and the second electrode wiring 3 in at least a part of the electrode wiring crossing region 9.

2 Claims, 8 Drawing Sheets

ELECTRON BEAM APPARATUS AND IMAGE DISPLAY APPARATUS

BACKGROUND OF THE INVENTION

1. Field of the Invention

The present invention relates to an electron beam apparatus having an electron emitting device and an image display apparatus having the electron beam apparatus.

2. Description of the Related Art

In order to reduce the power consumption of the image display apparatus having the electron beam apparatus, it is desirable to reduce the electrostatic capacitance of each electron emitting device and a drive circuit thereof and thereby reduce the charge/discharge current flowing into the electron emitting device and the drive circuit in a drive mode.

The conventional electron beam apparatus includes a plurality of strips of cathode wirings crossing a plurality of strips of gate wirings located above the cathode wirings, wherein an electron emitting device is arranged in each region where both types of the wirings cross each other. The gate wirings and the cathode wirings of the electron beam apparatus for the image display apparatus, when arranged in matrix, unavoidably cross each other, and an electrostatic capacitance develops in each region where the gate wiring and the cathode wiring cross each other through an insulating layer. Also, since each electron emitting device is formed in the region where both types of electrode wirings cross each other, a large area is required in each wiring crossing region to secure the space for arrangement of the electron emitting device. This tends to further increase the electrostatic capacitance in the crossing regions.

Japanese Patent Application Laid-Open No. 2-46636 discloses an image display apparatus including an electron emission unit of a planar type in which X-array electrodes (X-electrode wirings) and a Y-array electrodes (Y-electrode wirings) form a matrix electrode. Each electron emission unit is formed on the portion of the substrate surface other than the crossing regions between the X-array electrodes and the Y-array electrodes. Therefore, the electron emission unit is not arranged in the crossing portion of the X-array electrodes and the Y-array electrodes, so that the electrostatic capacitance between both types of the array electrodes is reduced.

SUMMARY OF THE INVENTION

Even in the electron beam apparatus having the electron emitting devices described in Japanese Patent Application Laid-Open No. 2-46636, the electrostatic capacitance is not reduced sufficiently, and a greater reduction in electrostatic capacitance is desired to reduce the power consumption. The present invention provides an electron beam apparatus in which the electrostatic capacitance in the crossing regions of the electrode wirings is easily reduced.

An electron beam apparatus according to the present invention comprising:

a substrate;

a first electrode wiring formed on the substrate;

an insulating layer covering the first electrode wiring;

a second electrode wiring formed on the insulating layer so as to cross the first electrode wiring; and an electron emitting device located at a region on the substrate distant from an electrode wiring crossing region where the first and second electrode wirings cross each other, and connected to both the first and second electrode wirings so as to receive drive energy from the first and second electrode wirings, wherein a void is formed between the first and second electrode wirings in at least apart of the electrode wiring crossing region.

In each electrode wiring crossing region, a void is formed between a first electrode wiring and a second electrode wiring. This produces the effect equivalent to a case in which at least a part of the insulating layer is replaced by a substance smaller in dielectric constant. Thus, the electrostatic capacitance between the first and second electrode wirings is reduced and so the charge/discharge current flowing into the electrode wiring crossing regions is reduced, thereby facilitating the reduction in power consumption.

Further features of the present invention will become apparent from the following description of exemplary embodiments with reference to the attached drawings.

DESCRIPTION OF THE EMBODIMENTS

First, an electron beam apparatus having an electron emitting device according to an embodiment is described with reference to the drawings. The material, shape and the production method of the electron emitting device according to this invention are not specifically limited. The surface conduction electron emitting device or the cold cathode device of field emission type or metal in metal (MIM) type can be used as the electron emitting device.

Figure 1A:
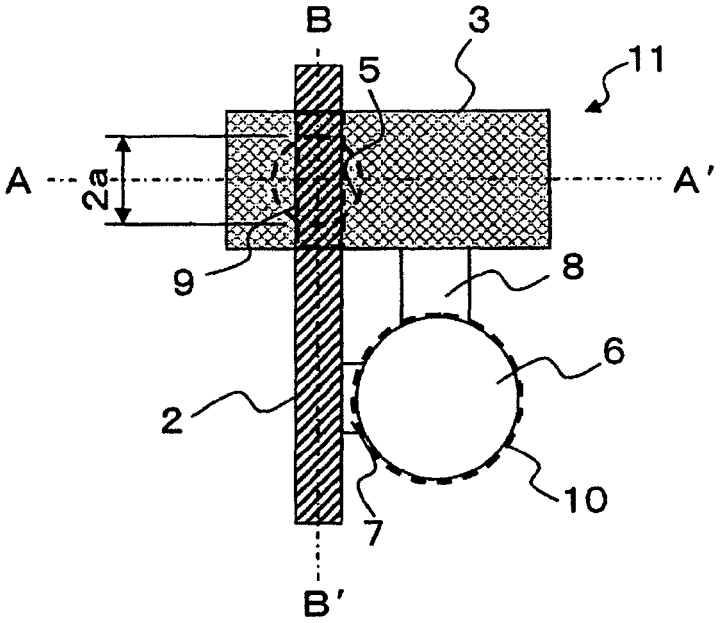
FIGS. 1A to 1C are schematic diagrams illustrating a part of an electron beam apparatus according to an embodiment of this invention.
Figure 1B:
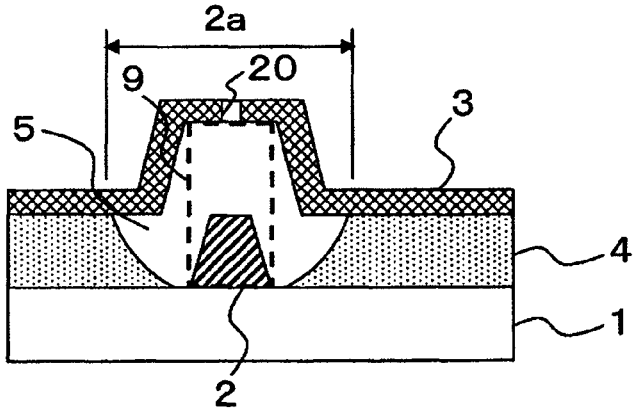
Figure 1C:
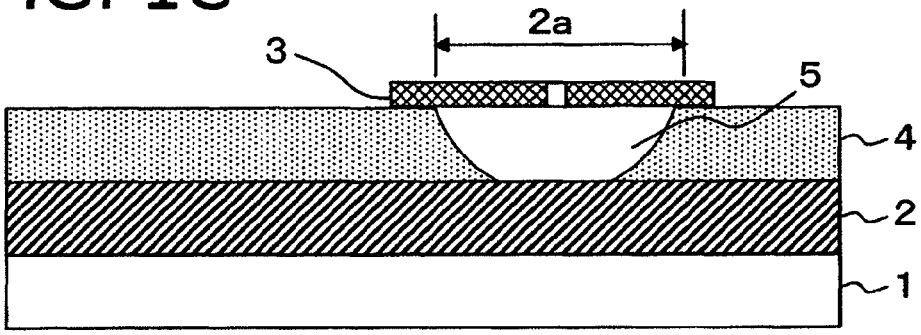

FIGS. 1A to 1C are schematic diagrams illustrating an electron beam apparatus according to an embodiment of the invention. FIG. 1A is a plan view schematically illustrating the apparatus, FIG. 1B a sectional view taken in line A-A' in FIG. 1A, and FIG. 1C a sectional view taken in line B-B' in FIG. 1A.

A first electrode wiring 2 is formed on a substrate 1 of an electron beam apparatus 11. The first electrode wiring 2 is covered by an insulating layer 4, on which a second electrode wiring 3 crossing the first electrode wiring 2 is formed. The region in which the first electrode wiring 2 and the second electrode wiring 3 cross each other on the substrate 1 constitutes an electrode wiring crossing region 9. An electron emitting device 6 is arranged in a region 10 distant from the electrode wiring crossing region 9. The electron emitting device 6 is connected to the first electrode wiring 2 through a device electrode 7, and to the second electrode wiring 3 through a device electrode 8. As a result, the electron emitting device 6 receives drive energy for emitting an electron from the first electrode wiring 2 and the second electrode wiring 3.

The substrate 1 is formed of an insulative material such as quartz glass, glass with a reduced content of impurities such as Na, soda lime glass, a laminated material with $SiO_2$ stacked by sputtering or the like on the soda lime glass or Si substrate, or ceramics such as alumina.

The first electrode wiring 2 and the second electrode wiring 3 are formed of a conductive metal using the vacuum deposition, printing or sputtering. The material, thickness and width of the wirings may be set appropriately. The first electrode wiring 2 and the second electrode wiring 3 may be formed of either the same material or different materials.

The insulating layer 4 is formed of a material including an oxide such as $SiO_2$ or a nitride such as $Si_3N_4$ having a high withstanding voltage resistive to a high electric field. The thickness of the insulating layer 4 is set appropriately in a range capable of securing a dielectric breakdown voltage.

The electron emitting device 6 is formed of a conductive film by sputtering, vacuum deposition or CVD. The conductive film may be formed also by dipping, spin coating or ink jet of a compound solution containing the material making up the conductive film. The material of the conductive film is appropriately selected from, for example, Pd, Pt, Ru, PdO and $SnO_2$. The thickness of the conductive film is set appropriately.

In the electron emitting device 6, a voltage is applied between a device electrode 7 and a device electrode 8 through the first electrode wiring 2 and the second electrode wiring 3. The electron emitting device 6, by thus generating an electric field therein for electron emission, emits electrons. One of the first electrode wiring 2 and the second electrode wiring 3 may constitute a gate electrode, and the other a cathode electrode.

The device electrodes 7 and 8 are formed of a conductive metal, etc. using a common vacuum film forming technique such as CVD, vacuum deposition or sputtering. The material of the device electrodes 7 and 8 is selected appropriately from metals such as Be, Mg, Ti, Zr, Hf, V, Nb, Ta, Mo, W, Al, Cu, Ni, Cr, Au, Pt and Pd or alloy materials. Any of carbides such as Tic, ZrC, HfC, TaC, SiC and WC, borides such as $HfB_2$, $ZrB_2$, $LaB_6$, $CeB_6$, $YB_4$ and $GbB_4$, nitrides such as TaN, TiN, ZrN and HfN, and semiconductors such as Si or Ge may alternatively be used as a material. An organic high polymer, amorphous carbon, graphite, diamond-like carbon or carbon or carbide dispersed with diamond may be selected as still another alternative. The thickness of the device electrodes 7 and 8 may be set appropriately.

The electron emitting device 6 is arranged in a region 10 different from the electrode wiring crossing region 9 in which the first electrode wiring 2 and the second electrode wiring 3 formed through the insulating layer 4 cross each other. As a result, the crossing area of the electrode wirings 2 and 3 in the electrode wiring crossing region 9 is not required to be increased to secure the region which otherwise might be required for arrangement of the electron emitting device 6, thereby making it possible to suppress the increase in the electrostatic capacitance in the electrode wiring crossing region 9. Further, according to this embodiment, a void 5 is formed by partial loss of the insulating layer 4 in the portion of the electrode wiring crossing region 9 between the first electrode wiring 2 and the second electrode wiring 3. Apparently, therefore, the insulating layer 4 between the first electrode wiring 2 and the second electrode wiring 3 is replaced by a material having a low dielectric constant, resulting in a reduced electrostatic capacitance of the electrode wiring crossing region 9. According to this embodiment, the void 5, though extending out of the electrode wiring crossing region 9 and having a substantially circular horizontal cross section, may alternatively be formed only inside the electrode wiring crossing region 9 and may have an elliptic or other appropriately shaped cross section.

Next, an example of the method for manufacturing the electron beam apparatus 11 described above is described with reference to FIGS. 2A to 2H.

Figure 2A:
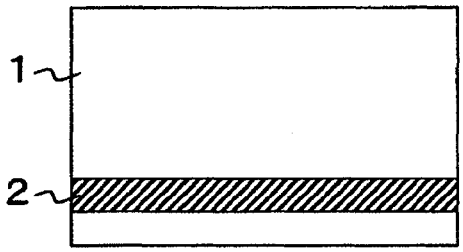
FIGS. 2A to 2H are schematic diagrams illustrating the sequential steps of producing the electron beam apparatus according to an embodiment of the invention.

The first electrode wiring 2 is formed on the substrate 1 with the surface thereof sufficiently cleaned in advance (FIG. 2A). The first electrode wiring 2 may be formed either by a common film forming technique such as vapor deposition or sputtering, or by printing. The method for manufacturing the first electrode wiring 2 is selected appropriately in accordance with the required thickness or width of the first electrode wiring 2.

Figure 2B:
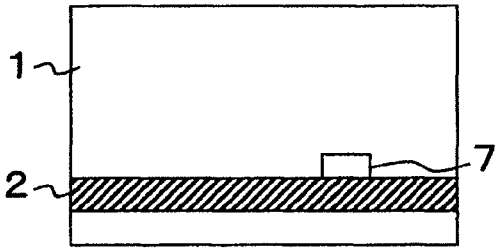

Then, a film providing the material of the device electrode 7 is deposited on the substrate 1 and the first electrode wiring 2 by a common film forming technique. Next, the film thus deposited is partially removed by photolithography thereby to form the device electrode 7 (FIG. 2B). As an example, the slit coating, the mask pattern exposure and development of the photoresist are carried out sequentially, and then the deposited film is removed partially by etching thereby to form the device electrode 7. The etching method can be appropriately selected in accordance with the material of the device electrode 7.

Figure 2C:
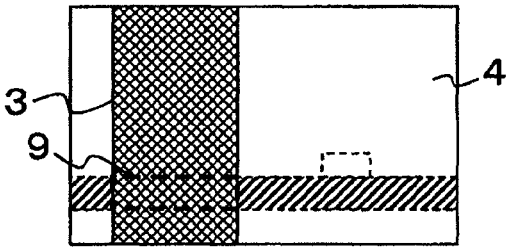

Next, the insulating layer 4 is formed on the substrate 1, the first electrode wiring 2 and the device electrode 7 by a common vacuum film forming method such as sputtering, CVD or vacuum deposition. Further, the second electrode wiring 3 is formed on the insulating layer 4 (FIG. 2C). The second electrode wiring 3 may be formed by either a common vacuum film forming technique such as vapor deposition or sputtering or by printing. The method for manufacturing the second electrode wiring 3 is appropriately selected in accordance with the thickness and the width required of the second electrode wiring 3. The second electrode wiring 3 may be formed either by the same method as the first electrode wiring 2 or by a different method.

Figure 2D:
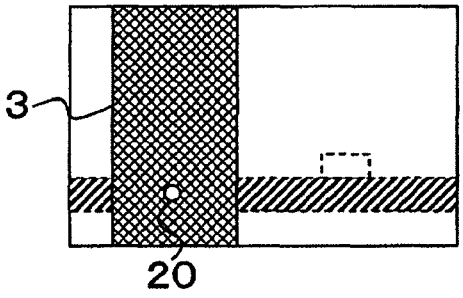

Then, the void 5 is formed. First, a resist pattern having an opening at the desired position on the second electrode wiring 3 is formed by photolithography. The size of the opening is selected in such a range that the etchant can flow in at the next etching session. Next, the opening 20 of the second electrode wiring 3 is formed by etching (FIG. 2D). The etching method can be appropriately selected in accordance with the material of the second electrode wiring 3. When Cu is used for the second electrode wiring 3, for example, the wet etching is desirably conducted by selecting a mixture solution of nitric acid, acetic acid and phosphoric acid as an etchant.

Figure 2E:
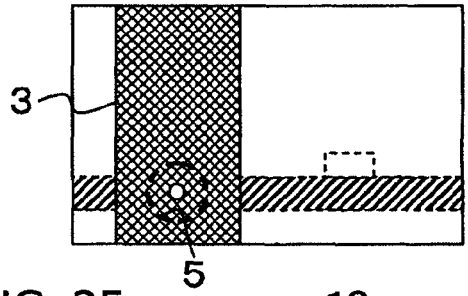

Then, the void 5 is formed in the insulating layer 4 by wet etching, etc. (FIG. 2E). When Cu is selected for the second electrode wiring 3 and $SiO_2$ for the insulating layer 4, for example, the wet etching is conducted using buffered fluoric acid as an etchant. As a result, the insulating layer 4 immediately under the opening 20 is selectively etched and the void 5 formed. After that, the etchant and the residue are cleaned off by dipping in pure water.

Figure 2F:
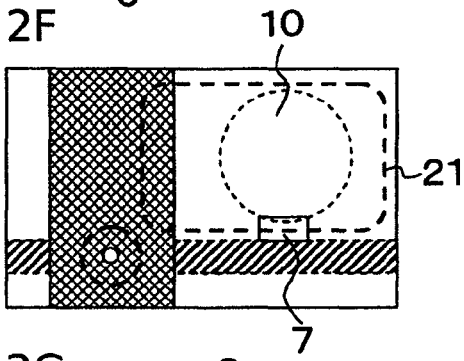

Next, the region 10 with the electron emitting device 6 arranged therein is formed. First, a resist pattern is formed by photolithography in the desired part on the first electrode wiring 2 and the second electrode wiring 3. Then, by removing a part of the insulating layer 4 by etching, an opening 21 including the region 10 is formed (FIG. 2F). The opening 21 is formed in such a manner as to cover at least a part of the second electrode wiring 3 desirably to partially expose the second electrode wiring 3. The etching step may be stopped on the upper surface of the substrate 1 or etch the substrate 1 partially. The etching method can be selected appropriately in accordance with the material of the insulating layer 4. When $SiO_2$ is selected for the insulating layer 4, for example, the wet etching is desirably conducted using buffered fluoric acid as an etchant. This etching step may be executed at the same time that the void 5 is formed.

Figure 2G:
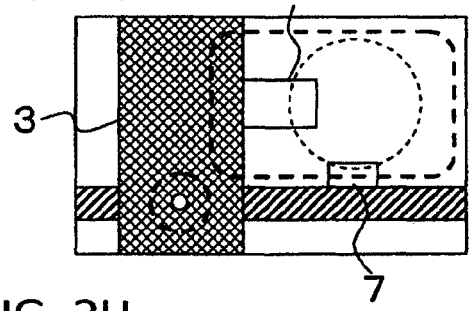

Next, the device electrode 8 is formed. First, a film providing the material of the device electrode 8 is deposited by a common film forming technique. Then, by removing a part of the deposited film by photolithography, the device electrode 8 is formed in such a manner as to be connected to a part of the second electrode wiring 3 exposed to the opening 21 (FIG. 2G). As an example, the photoresist is subjected to slit coating, mask pattern exposure and development sequentially, and by etching off a part of the deposited film, the device electrode 8 is formed. The etching method can be appropriately selected in accordance with the material of the device electrode 8.

Figure 2H:
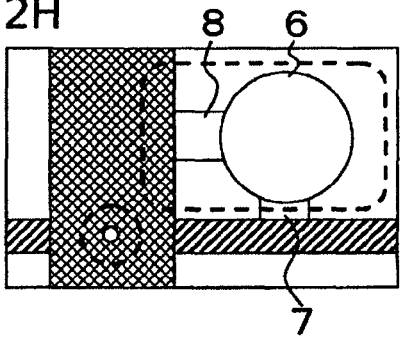

Next, the electron emitting device 6 is formed. First, a conductive film is formed by the ink jet method in such a manner as to be connected to the device electrode 7 and the device electrode 8. Then, power is supplied to the conductive film through the first electrode wiring 2 and the second electrode wiring 3 thereby to execute the electroforming process and the electroactivation process. By following these steps, the electron emitting device 6 is formed (FIG. 2H).

Several embodiments of the image display apparatus having the electron beam apparatus 11 according to an embodiment of the invention are described below.

(Image Display Apparatus According to First Embodiment)

Figure 3:
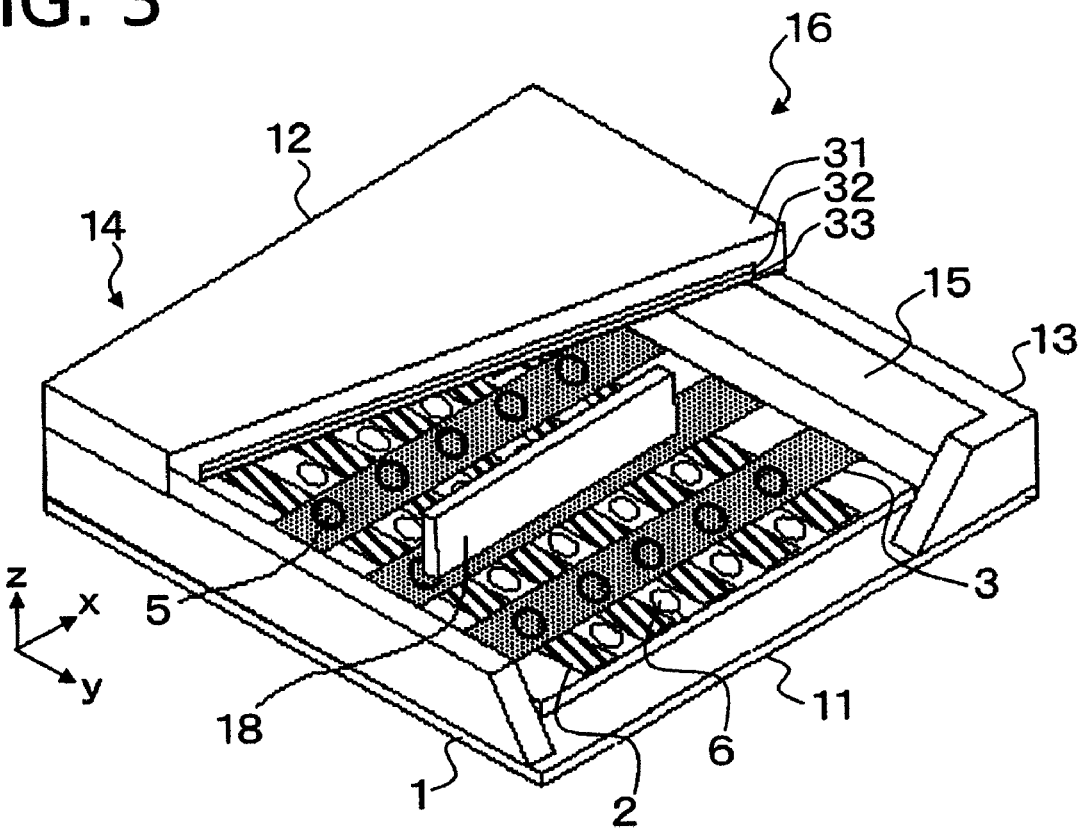
FIG. 3 is a schematic diagram illustrating the configuration of the image display apparatus according to a first embodiment of the invention.

FIG. 3 schematically illustrates an image display apparatus according to a first embodiment. The image display apparatus 16 includes the electron beam apparatus (rear plate) 11, an image forming member (face plate) 12 and a support frame 13 located between and forming an airtight container 14 with the electron beam apparatus 11 and the image forming member 12. The internal space 15 of the airtight container 14 is maintained at a pressure lower than the atmospheric pressure, and the electron beam apparatus 11 and the image forming member 12 are arranged in opposed relation to each other with the internal space 15 therebetween. The support frame 13 is coupled to both the electron beam apparatus 11 and the image forming member 12 with frit glass or the like having a low melting point.

Figure 4:
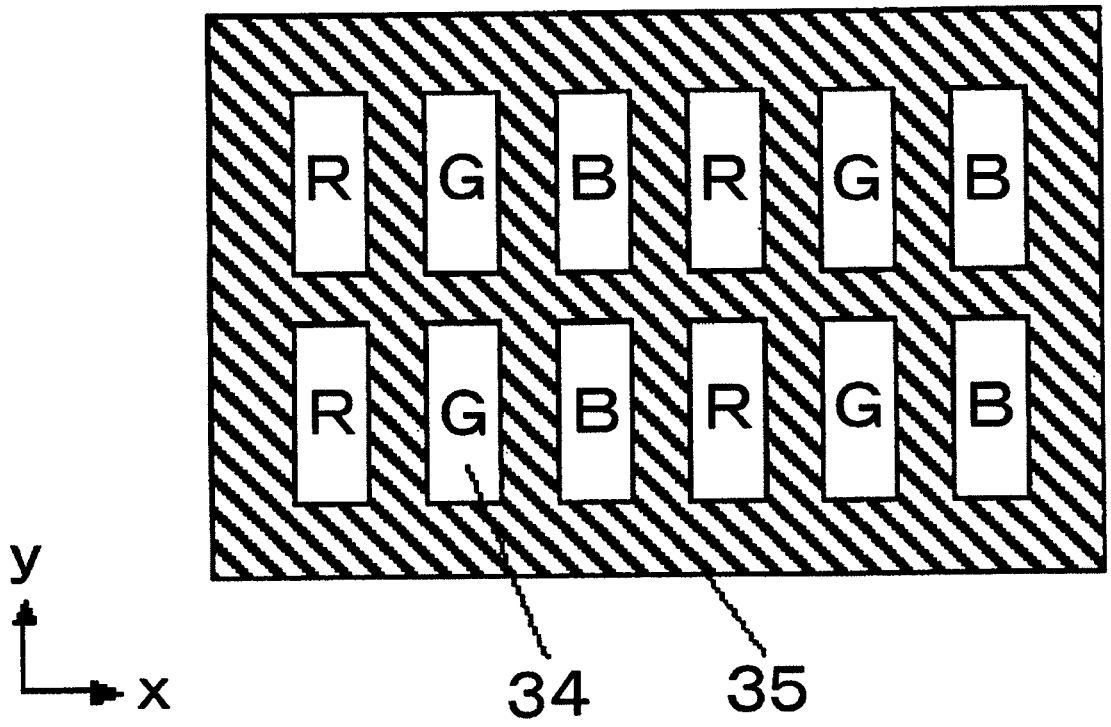
FIG. 4 is a schematic diagram illustrating the configuration of the fluorescent film of the image display apparatus illustrated in FIG. 3.

The image forming member 12 includes a glass substrate 31, a fluorescent film 32 making up a light-emitting member and a metal back 33. The electrons emitted from the electron beam apparatus 11 are collided on the fluorescent film 32, which in turn emits light thereby to form an image. A part of the fluorescent film 32 is schematically illustrated in FIG. 4. Fluorescent members 34 corresponding to the desired emission color are regularly arranged, and by emitting light from the desired one of the phosphors 34, an image is displayed on the outer surface of the glass substrate 31. The phosphors 34 are each assigned to one of the three primary colors of R (red), G (green) and B (blue) required for color display. The phosphors 34 of R, G, and B are arranged in that order along X direction, for example, and the phosphors 34 of the same color along Y direction. The phosphors 34 are separated by a light absorption member 35, so that the color mixing between the phosphors 34 of different colors and the contrast reduction are suppressed.

The first electrode wirings 2 in a predetermined number corresponding to the number of pixels of the image display apparatus are arranged in parallel to each other on the substrate 1 of the electron beam apparatus 11. Similarly, the second electrode wirings 3 in a predetermined number corresponding to the number of pixels of the image display apparatus are arranged in parallel to each other on the substrate 1 of the electron beam apparatus 11 through the insulating layer 4 (FIG. 1B). The first electrode wirings 2 and the second electrode wirings 3 are arranged orthogonally to each other, and the crossings thereof each constitute an electrode wiring crossing region 9 (FIG. 1B). A void 5 is formed in each electrode wiring crossing region 9. Incidentally, the void is displayed in a highlighted fashion in FIG. 3 and FIGS. 6 and 7 described below. An electron emitting device 6 corresponding to each electrode wiring crossing region 9 is arranged adjacently to the particular electrode wiring crossing region 9. A plate-like spacer 18 is arranged on the second electrode wirings 3. The spacer 18 provides a sufficient pressure strength to the airtight container 14 against the force to deform the airtight container 14 inward under the atmospheric pressure. The spacer 18 is not required to be arranged on all the second electrode wirings 3, but only on a part of the second electrode wirings 3 at a predetermined pitch to such a degree as required for pressure resistance.

Figure 5:
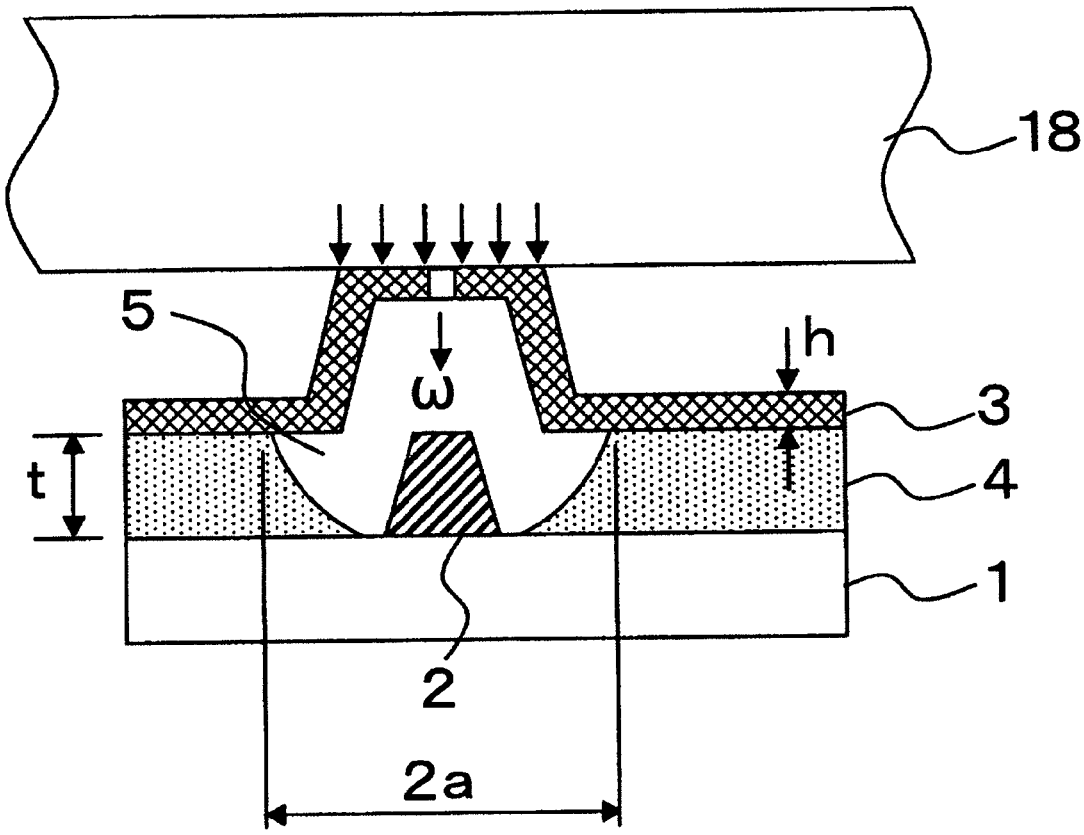
FIG. 5 is a schematically sectional view for explaining the deflection of the second electrode wiring.

As illustrated in FIG. 5, the second electrode wiring 3 is pressed by the spacer 18 due to the pressure difference between the inside and the outside of the airtight container 14, so that the second electrode wiring 3 is deflected toward the first electrode wiring 2. The deflection ω of the second electrode wiring 3 at the center of the void 5 desirably satisfies the relation:

$$\omega=3.42\times10^{-7}\times(m\times a^4)/h^3<(1-(1/\in))\times t,$$

where m: (interval of spacers 18×width of pixel along X direction)/(length of spacer 18 along Y direction×width of first electrode wiring 2)

a: A half value (m) of maximum width of void 5 h: Thickness (m) of second electrode wiring 3

∈: Dielectric constant of insulating layer 4 t: Thickness (m) of insulating layer 4

The pixel is defined as a phosphor 34 of the image forming member 12 corresponding to each electron emitting device 6, and the width of the pixel along an X direction corresponds to the width thereof along the longitudinal direction of the spacer 18. Also, the length of the spacer in a Y direction is the thickness of the spacer. Incidentally, the coefficient m has no unit.

The deflection of the second electrode wiring 3 reduces the interval between the first electrode wiring 2 and the second electrode wiring 3, while at the same time increasing the electrostatic capacitance between the wirings 2 and 3. On the other hand, the presence of the void 5 reduces the electrostatic capacitance between the wirings 2 and 3. By decreasing the deflection ω below (1−(1/∈))×t, the increment of the electrostatic capacitance between the first electrode wiring 2 and the second electrode 3 can be made smaller than the decrement of the same electrostatic capacitance. As a result, the electrostatic capacitance between the wirings 2 and 3 is reduced and the power consumption of the image display apparatus is suppressed.

(Image Display Apparatus According to Second Embodiment)

Figure 6:
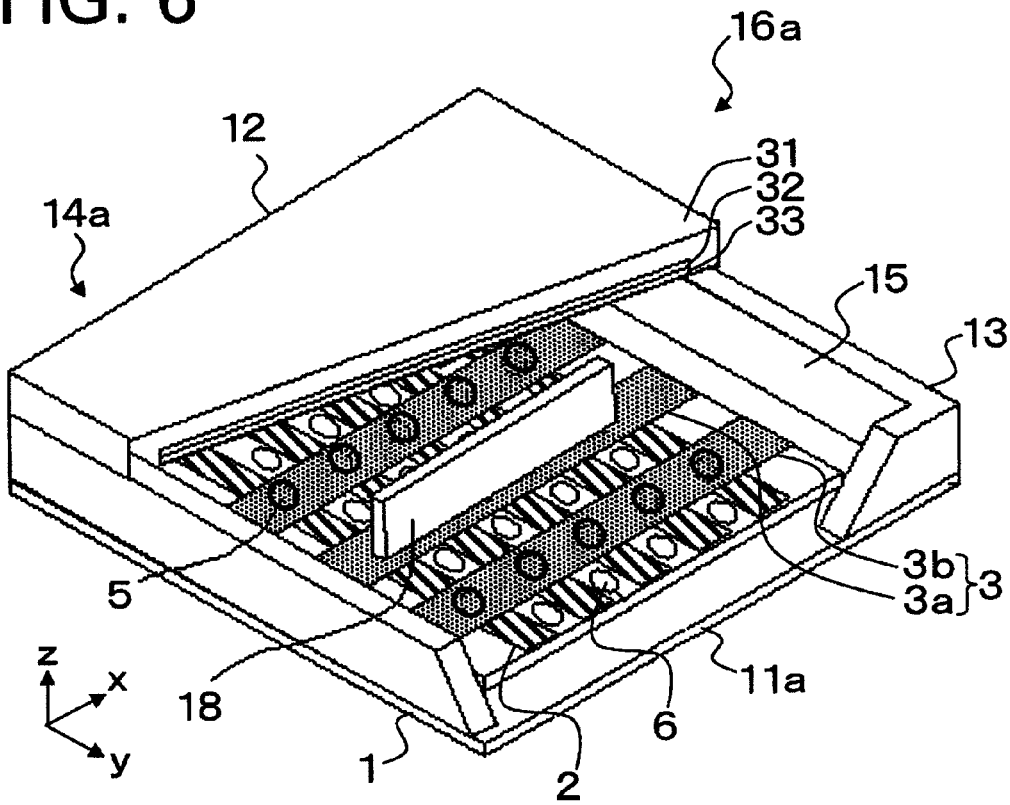
FIG. 6 is a schematic diagram illustrating the configuration of the image display apparatus according to a second embodiment of the invention.

FIG. 6 schematically illustrates the image display apparatus according a second embodiment. This embodiment is different from the first embodiment only in the position where the void is formed and the arrangement of the spacer, and the remaining points remain the same as in the first embodiment. As to any matter not described below, therefore, refer to the first embodiment.

According to this embodiment, the airtight container 14*a* includes an electron beam apparatus 11*a* and an image forming member 12 arranged in opposed relation to the electron beam apparatus 11*a* with an internal space maintained at a pressure lower than the atmospheric pressure therebetween. The image forming member 12 has a similar configuration to the first embodiment.

A plurality of the second electrode wirings 3 are arranged in parallel to each other. According to this embodiment, some of the second electrode wirings 3*a* except for the remaining second electrode wirings 3*b* are not formed with the void 5 in the electrode wiring crossing region 9. A plate-like spacer 18 similar to the corresponding one of the first embodiment is arranged only on the second electrode wirings 3*a* not formed with the void 5.

The shape and the points (intervals) of arrangement of the spacers 18 are determined in such a manner as to stand the external force of an atmospheric pressure. The potential distribution between the image forming member 12 and the electron beam apparatus 11, however, is affected and varied by the presence of the spacer 18. The variation of the potential distribution may have an adverse effect on the trajectory of the electrons emitted from the electron emitting device 6. To prevent the adverse effect on the electron trajectory, the spacer 18 is desirably located at a position as far as possible from the electron emitting device 6. The point on the second electrode wiring 3 is one of the desired locations. If the external force of the atmospheric pressure is imposed on the airtight container, on the other hand, the second electrode wiring 3 is pressed by the spacer 18, and this force is transmitted to the substrate 1 through the insulating layer 4. In the absence of the insulating layer 4 in the electrode wiring crossing region 9, however, the second electrode wiring 3 may be deflected and shorted by contact with the first electrode wiring 2 immediately under the second electrode wiring 3. Even if no shorting occurs, the interval between the first electrode wiring 2 and the second electrode wiring 3 may be extremely reduced, thereby probably increasing the electrostatic capacitance. In other words, the second electrode wiring 3 having the void 5, though depending on the size of the void 5, may not always be suitable for supporting the spacer 18, and the spacer 18, to be supported securely, is preferably arranged in spaced relation with the second electrode wiring 3.

According to this embodiment, the electrostatic capacitance in the electrode wiring crossing region 9 having the void 5 is suppressed by forming the void 5 in the second electrode wiring 3*b*. The void 5 is not formed but the insulating layer 4 is formed, on the other hand, in the second electrode wiring 3*a* immediately under the spacer 18 required to have a sufficient strength to support the spacer. Therefore, the spacer 18 is stably supported on the substrate 1 through the second electrode wiring 3*a* as in the conventional art. This configuration of the present embodiment can meet the aforementioned two conflicting requirements at the same time.

(Image Display Apparatus According to Third Embodiment)

Figure 7:
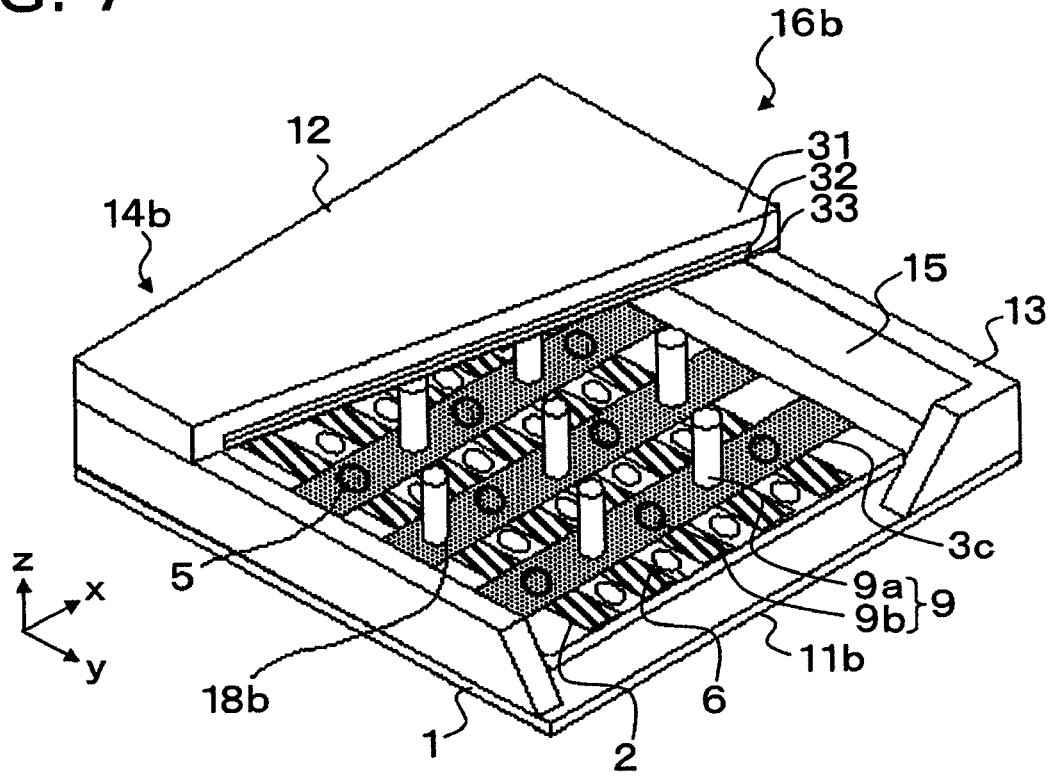
FIG. 7 is a schematic diagram illustrating the configuration of the image display apparatus according to a third embodiment of the invention.

FIG. 7 schematically illustrates an image display apparatus according to a third embodiment. This embodiment is different from the first embodiment only in the position of the void and the arrangement of the spacer, and similar to the first embodiment in the other points. As to the points not described below, refer to the first embodiment.

According to this embodiment, the airtight container 14*b* includes an electron beam apparatus 11*b* and an image forming member 12 arranged in opposed relation to the electron beam apparatus 11*b* with the internal space maintained at a pressure lower than the atmospheric pressure therebetween. The image forming member 12 is configured in the same way as that of the first embodiment.

The second electrode wirings 3*c* each have a plurality of the electrode wiring crossing regions 9. The void 5 is not formed in some of the electrode wiring crossing regions 9*a*, but formed in the remaining electrode wiring crossing regions 9*b*. A columnar spacer 18*b* is arranged only on the electrode wiring crossing regions 9*a* not formed with the space 5.

In arranging the spacer 18*b*, as in the second embodiment, the two conflicting factors of prevention of the adverse effect on the electron trajectory and supporting the spacer are desirably both satisfied. To prevent the adverse effect on the electron trajectory, arranging a given columnar spacer 18*b* in the electrode wiring crossing region 9 is very preferably equivalent to locating the particular spacer 18*b* at a position further distant from the electron emitting device 6 as compared with the second embodiment. If an electrode wiring crossing region 9 has a void, however, the same problem as in the second embodiment is posed. According to this embodiment, therefore, the electrostatic capacitance in some electrode wiring crossing regions 9*b* having the void 5 is suppressed by forming the void 5 in the particular electrode wiring crossing regions 9*b*. On the other hand, the void 5 is not formed but the insulating layer 4 is formed in the electrode wiring crossing regions 9*a* immediately under the spacer 18*b* which are required to have a strength sufficient to support the spacer 18*b*. Therefore, such a spacer 18*b* is stably supported on the substrate 1 as in the conventional art through the electrode wiring crossing region 9*a*. According to this embodiment, this configuration makes it possible to meet the two conflicting requirements.

EXAMPLES

Specific examples of the invention are described in detail below.

First Example

This example refers to the electron beam apparatus 11 illustrated in FIGS. 1A to 1C.

(Step 1)

The substrate 1 of soda lime glass, after being sufficiently cleaned, is subjected to the slit coating of a positive photoresist (TSMR-8900 of TOKYO OHKA KOGYO, Co., Ltd.) in a photolithography step. Then, a liftoff pattern having an opening is formed by exposing and developing the photoresist with a photomask pattern. After that, a Cu film having a thickness of 3 μm is deposited by sputtering, and the first electrode wiring 2 having a width of 25 μm is formed by liftoff (the state illustrated in FIG. 2A).

(Step 2)

Then, a TaN film having a thickness of 100 nm is deposited by sputtering as a film to be a material of the device electrode 7 on the substrate 1 and the first electrode wirings 2. Next, as in step 1, a resist pattern is formed by photolithography. After that, the deposited film is dry-etched using the $SF_6$ gas with the patterned photoresist as a mask, and by stopping etching on the substrate 1, the device electrode 7 is formed (the state illustrated in FIG. 2B). The device electrode 7 is formed in overlapped relation with the first electrode wiring 2.

(Step 3)

Then, a $SiO_2$ film (dielectric constant ∈ of 4) having a thickness of 3 μm is formed as an insulating layer 4 by sputtering on the substrate 1, the first electrode wiring 2 and the device electrode 7.

(Step 4)

Then, a Cu film having a thickness of 2 μm and a width of 320 μm is formed as the second electrode wiring 3 by printing using a mask on the insulating layer 4 (the state illustrated in FIG. 2C). According to this example, the electrode wiring crossing regions 9 are formed in a matrix of 320×240.

(Step 5)

Then, in the photolithography step, like in the aforementioned step, the photoresist is exposed and developed with a photomask pattern thereby to form a resist pattern having an opening to serve as an opening 20 and an opening 21. After that, with the patterned photoresist as a mask, the opening 20 is formed by wet etching of the second electrode wiring 3 (the state illustrated in FIG. 2D). For etching, a mixed acid is used, which is constituted of a mixture solution: 2.19% of nitric acid; 32.24% of acetic acid; 43.75% of phosphoric acid; and 21.82% of water. Incidentally, $SiO_2$ for the opening 21 is not etched in this step.

(Step 6)

The buffered fluoric acid (LAL100 of Stella Chemifa Corporation) is supplied as an etching solution into the opening 20 formed in step 5, and the wet etching is conducted for six minutes while at the same time forming an opening 21. The opening 21 is formed with the second electrode wiring 3 partially exposed and the device electrode 7 also exposed. After that, the cleaning process is executed by dipping in pure water for ten minutes thereby to remove the etchant and the residue. Then, the resist pattern formed in step 5 is separated (the state illustrated in FIGS. 2E and 2F).

(Step 7)

Then, a TaN film having a thickness of 100 nm is deposited by sputtering as a film to be a material of the device electrode 8. Next, like in step 1, a resist pattern is formed by photolithography. After that, with the patterned photoresist as a mask, the deposited film is dry-etched using $SF_6$ gas, and the etching is stopped on the substrate 1 thereby to form a device electrode 8 (the state illustrated in FIG. 2G). The device electrode 8 is formed in such a manner as to be connected to a part of the second electrode wiring 3.

(Step 8)

Finally, the organic Pd solution is coated for baking by the ink jet method thereby to form a conductive film superposed on the device electrodes 7 and 8. After that, the electroforming process and the electroactivation process are executed to form electron emitting devices 6 (the state illustrated in FIG. 2H). The electron emitting devices 6 are formed in a matrix of 320×240.

The sectional view of the electron beam apparatus manufactured as described above was confirmed under the scanning electron microscope (SEM), with the result that the opening 20 was found to have a width of 1 μm and the void 5 was found to have the maximum width of 30 μm. The electrostatic capacitance between the first electrode wiring 2 and the second electrode wiring 3 was found to be 0.05 pF.

Figure 8:
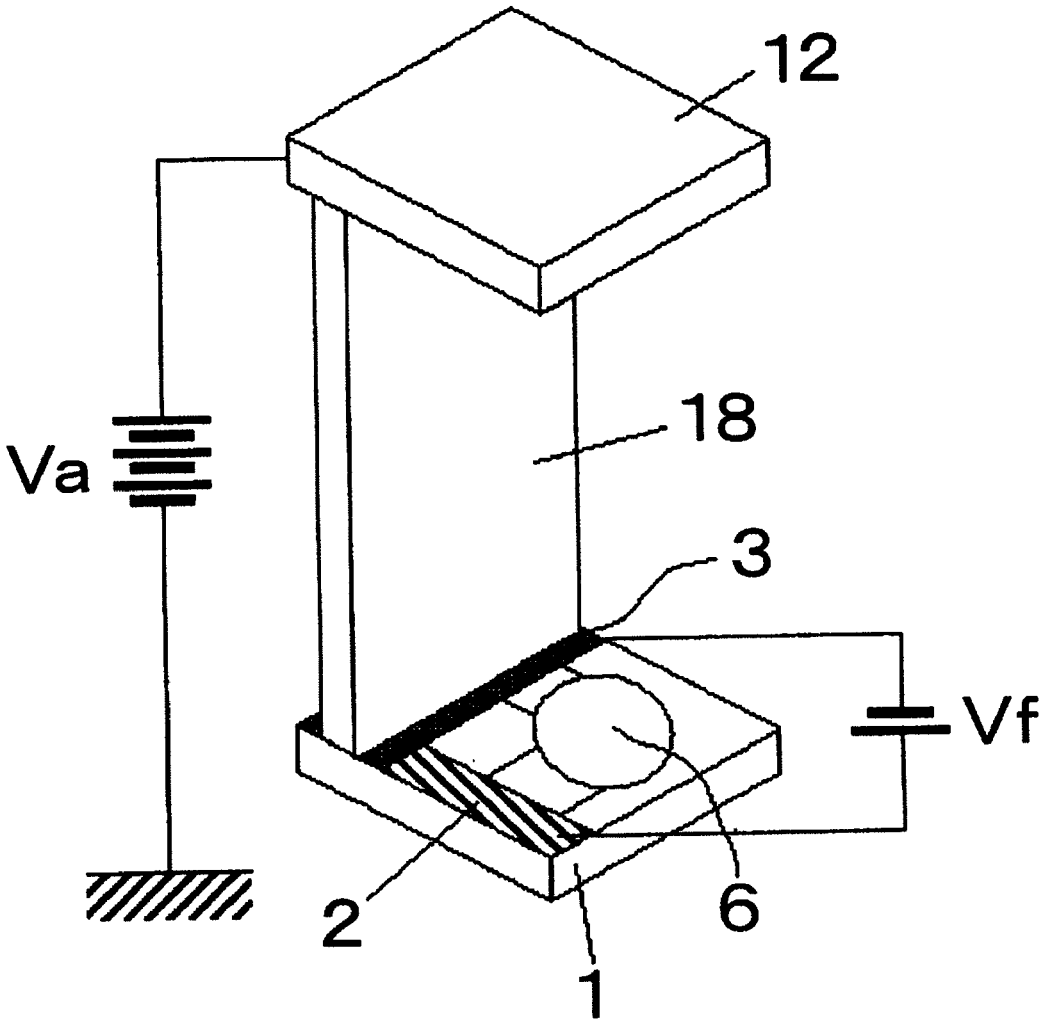
FIG. 8 is a diagram illustrating an example of the method for operating the electron beam apparatus according to an embodiment of the invention.

The electron beam emitted from the electron beam apparatus according to this example was observed. A schematic diagram of the apparatus used for observation of the electron beam is illustrated in FIG. 8. The spacer 18 having a thickness of 2.0 mm and a width of 200 μm was arranged on the second electrode wiring 3 on the substrate 1 of the electron beam apparatus, and further, an image forming member (face plate) 12 with a phosphor was arranged thereon. The image forming member 12 was impressed with a voltage Va of 6 kV and the first electrode wiring 2 was impressed with a gate voltage Vf of 16 V, so that the emitted electrons were collided on the image forming member 12. By thus exciting and emitting the light from the image forming member 12 and displaying an electron beam image, the electron emission was confirmed. Similarly, the electron emission could be confirmed also by applying the gate voltage Vf of 16 V to the second electrode wiring 3.

Comparative Example

An electron beam apparatus according to a comparative example was manufactured in the same steps as in the first example except that the void 5 was not formed in the insulating layer 4. Specifically, steps 1 to 4 of the first example were executed first of all, and by exposing and developing a photoresist with a photomask pattern in the photolithography step, a resist pattern having an exposure opening 21 was formed. Next, the wet etching was carried out with the buffered fluoric acid (LAL100 of Stella Chemifa Corporation) as an etching solution using, as a mask, the photoresist having an opening pattern formed in the preceding step to expose the electron emission region. The insulating layer 4 was selectively etched and the opening 21 formed. The opening 21 was formed in such a manner as to partially expose the second electrode wiring 3 thereby to expose also the device electrode 7. After that, steps 7 and 8 of the first example were executed. The electrostatic capacitance between the first electrode wiring 2 and the second electrode wiring 3 of the electron beam apparatus manufactured in this way was 0.18 pF.

Second Example

This example represents a case in which the image display apparatus illustrated in FIG. 3 is manufactured using the electron beam apparatus manufactured in the first example.

In the electron beam apparatus 11 according to the first example, the width of the first electrode wiring 2 was set to 25 μm, the width of the second electrode wiring 3 was set to 320 μm, and the size of the pixel was set to 200 μm×630 μm, with 320×240 electron emitting devices arranged in matrix on the substrate 1. In the electron beam apparatus 11 according to this example, a void 5 was formed in every insulating layer 4 in the electrode wiring crossing region 9 of the first electrode wiring 2 and the second electrode wiring 3.

Next, the image forming member (face plate) 12 was sealed at a position above the substrate 1 by 2 mm through a support frame 13 in vacuum thereby to form an airtight container 14. A plate-like spacer 18 having an X-direction length of 64 mm and a Y-direction length of 200 μm was arranged between the substrate 1 and the image forming member 12 to make up a structure resistant to the atmospheric pressure. Five spacers 18 were used in all. A getter (not illustrated) was arranged in the airtight container 14 to hold the interior in a high vacuum. The substrate 1 was coupled to the support frame 13 using indium and the support frame 13 was coupled to the image forming member 12 using indium.

Next, the electron emitting device 6 was driven by applying an information signal to the first electrode wiring 2 and a scanning signal to the second electrode wiring 3. A pulse voltage of +6 V was used as the information signal, and a pulse voltage of −10 V as the scanning signal. By applying a voltage of 6 kV to the metal back, the emitted electrons were collided on the fluorescent film, excited, and light-emitted to display an image. In this way, a bright image could be displayed.

The image display apparatus manufactured in the above manner was disassembled to confirm, under the scanning electron microscope (SEM), the cross section of the dent of the portion of the second electrode wiring 3 in contact with the spacer 18 thereon. The amount of deflection of the second electrode wiring 3 due to the pressure stress of the spacer was 1.75 μm. The amount of deflection of the second electrode wiring 3 was smaller than $(1-(1/\in))\times t$ ($\in=4$, $t=3$ μm)=2.25 μm.

The measurement of the electrostatic capacitance of the image display apparatus according to this example confirmed that the electrostatic capacitance was reduced to 29% of the figure for the conventional art. At the same time, the power consumption could be reduced.

Third Example

This example describes a case in which the image display apparatus according to the third embodiment illustrated in FIG. 7 is manufactured using the electron beam apparatus 11 manufactured according to this invention. Only the points of this invention which are different from those of the first and second examples are described below.

According to this example, like in the first example, the electrode wiring crossing region 9 is formed in a matrix of 320×240. The voids 5 are formed in such a manner that the electrode wiring crossing region 9*b* having the void 5 and the electrode wiring crossing region 9*a* lacking the void 5 are arranged alternately, i.e. in a staggered pattern with each other. As a result, the electrode wiring crossing region formed with the void 5 is one half smaller than the corresponding region in the second example. A columnar spacer 18*b* having a radius of 100 μm is arranged in the electrode wiring crossing region 9*a* lacking the void 5 to support the substrate 1 and the image forming member 12.

The image display apparatus manufactured in the above manner was disassembled and checked. Since the spacer 18*b* is not arranged in the electrode wiring crossing region 9*b* formed with the void 5, the deflection of the second electrode wiring 3 could not be confirmed. Also, the measurement of the capacitance of the image display apparatus like in the second example could be reduced to 57% of the figure for the conventional art. At the same time, the power consumption was reduced correspondingly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-114592, filed on May 11, 2009, which is hereby incorporated by reference herein in its entirety.

What is claimed is:

1. An image display apparatus, comprising an airtight container including:

an electron beam apparatus;

an image forming member for forming an image with electrons emitted from the electron beam apparatus, which is located in opposed relation to the electron beam apparatus with an internal space maintained therebetween at a pressure lower than the atmospheric pressure; and a plate-like spacer located between the electron beam apparatus and the image forming member, wherein the electron beam apparatus includes a substrate;

a first electrode wiring formed on the substrate;

an insulating layer covering the first electrode wiring;

a second electrode wiring formed on the insulating layer so as to cross the first electrode wiring; and on the substrate, an electron emitting device located distant from an electrode wiring crossing region where the first and second electrode wirings cross each other, and connected to both the first and second electrode wirings so as to receive drive energy from the first and second electrode wirings, wherein a void is formed between the first and second electrode wirings in at least a part of the electrode wiring crossing region, a plurality of the second electrode wirings are arranged in parallel to each other, the void is formed in the electrode wiring crossing region of each of the second electrode wirings, the plate-like spacer is arranged only on a part of the second electrode wirings, the electron beam apparatus includes a plurality of electron emitting devices, the image forming member includes a plurality of phosphors corresponding to the plurality of the electron emitting devices, respectively, and the deflection ω of the second electrode wiring caused at the center of the void by the pressure imposed by the spacer on the second electrode wiring due to the pressure difference between the inside and the outside of the airtight container satisfies the relation:

$$\omega=3.42\times10^{-7}\times(m\times a^4)/h^3<(1-(1/\in))\times t,$$

where m: (interval of the spacers×width of pixel along the longitudinal direction of the spacers)/(thickness of the spacer×width of the first electrode wiring)

a: Half value (m) of maximum width of the void h: Thickness (m) of the second electrode wiring ∈: Dielectric constant of the insulating layer t: Thickness (m) of the insulating layer, wherein the pixel is a phosphor of the image forming member corresponding to each electron emitting device.

2. An image display apparatus comprising an airtight container including:

an electron beam apparatus;

an image forming member for forming an image with electrons emitted from the electron beam apparatus, which is located in opposed relation to the electron beam apparatus with an internal space maintained therebetween at a pressure lower than the atmospheric pressure; and a plate-like spacer located between the electron beam apparatus and the image forming member, wherein the electron beam apparatus includes a substrate;

a first electrode wiring formed on the substrate;

an insulating layer covering the first electrode wiring;

a second electrode wiring formed on the insulating layer so as to cross the first electrode wiring; and on the substrate, an electron emitting device located distant from an electrode wiring crossing region where the first and second electrode wirings cross each other, and connected to both the first and second electrode wirings so as to receive drive energy from the first and second electrode wirings, wherein a void is formed between the first and second electrode wirings in at least a part of the electrode wiring crossing region, a plurality of the second electrode wirings are arranged in parallel to each other, the electrode wiring crossing region of a part of the second electrode wirings is not formed with the void, the plate-like spacer is arranged only on the second electrode wiring not formed with the void, the electron beam apparatus includes a plurality of electron emitting devices, the image forming member includes a plurality of phosphors corresponding to the plurality of the electron emitting devices, respectively, and the deflection ω of the second electrode wiring caused at the center of the void by the pressure imposed by the spacer on the second electrode wiring due to the pressure difference between the inside and the outside of the airtight container satisfies the relation:

$$\omega=3.42\times10^{-7}\times(m\times a^4)/h^3<(1-(1/\in))\times t,$$

where m: (interval of the spacers×width of pixel along the longitudinal direction of the spacers)/(thickness of the spacer×width of the first electrode wiring)

a: Half value (m) of maximum width of the void h: Thickness (m) of the second electrode wiring ∈: Dielectric constant of the insulating layer t: Thickness (m) of the insulating layer, wherein the pixel is a phosphor of the image forming member corresponding to each electron emitting device.

* * * * *